US007226286B2

(12) United States Patent
Schröter

(10) Patent No.: US 7,226,286 B2
(45) Date of Patent: Jun. 5, 2007

(54) APPARATUS FOR GUIDING, TREATING, OR CONVEYING AT LEAST ONE YARN

(75) Inventor: Michael Schröter, Remscheid (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 89 days.

(21) Appl. No.: 10/997,839

(22) Filed: Nov. 24, 2004

(65) Prior Publication Data

US 2005/0071968 A1 Apr. 7, 2005

Related U.S. Application Data

(63) Continuation of application No. PCT/EP03/06231, filed on Jun. 13, 2003.

(30) Foreign Application Priority Data

Jun. 19, 2002 (DE) ..... 102 27 290

(51) Int. Cl.
*F27B 9/28* (2006.01)

(52) U.S. Cl. ..... 432/59; 242/474.4

(58) Field of Classification Search ..... 432/8, 432/59, 60, 228; 242/474.4, 474.5, 474.6; 219/216; 492/46
See application file for complete search history.

(56) References Cited

U.S. PATENT DOCUMENTS 3,576,081 A 4/1971 McCrary
6,045,084 A * 4/2000 Binner et al. ..... 242/486.7
6,120,715 A 9/2000 Weigend
6,161,790 A * 12/2000 Westrich ..... 242/486.4
6,402,080 B1 * 6/2002 Blankenhorn ..... 242/477.6
6,441,353 B1 8/2002 Gehrmann et al.
6,990,795 B2 * 1/2006 Wortmann et al. ..... 57/284

FOREIGN PATENT DOCUMENTS

| | | |
|---|---|---|
| DE | 37 04 279 A1 | 9/1987 |
| DE | 197 33 239 A1 | 2/1999 |
| DE | 199 16 607 A1 | 10/1999 |
| DE | 198 43 990 | 8/2002 |
| EP | 0 861 800 A2 | 9/1998 |
| EP | 1 001 521 A2 | 5/2000 |
| JP | 59-17460 | 1/1984 |
| JP | 36 13 040 A1 | 1/1987 |

* cited by examiner

*Primary Examiner*—Gregory Wilson
(74) *Attorney, Agent, or Firm*—Alston & Bird LLP

(57) ABSTRACT

An apparatus for guiding, treating, or advancing at least one yarn (1), comprising a delivery roll (2) and a companion roll (3) cooperating with the delivery roll so that the yarn repeatedly loops the delivery roll (2) and the companion roll (3). The delivery roll and the companion roll are driven by associated electric motors (7, 8), which are controlled via control lines (9) at a desired frequency by a controller (10). To enable an equalization of the circumferential speeds of the delivery roll (2) and the companion roll (3), the electric motor of the companion roll is an asynchronous motor that is controlled by the desired frequency and has a motor slip.

9 Claims, 2 Drawing Sheets

APPARATUS FOR GUIDING, TREATING, OR CONVEYING AT LEAST ONE YARN

CROSS REFERENCE TO RELATED APPLICATION

The present application is a continuation of international application PCT/EP2003/006231, filed 13 Jun. 2003, and which designates the U.S. The disclosure of the referenced application is incorporated herein by reference.

BACKGROUND OF THE INVENTION

The present invention relates to an apparatus for guiding, treating, or advancing at least one yarn, of the type commonly used in a melt spinning process. In such process, it is known to use apparatus of the type which comprise a delivery roll and a companion roll associated therewith for enabling a repeated looping of the yarn. In this arrangement, the delivery roll is driven, whereas the companion roll may be constructed with or without a drive unit, as is disclosed, for example, in EP 1 001 521 A2.

According to EP 1 001 521 A2, the delivery roll and the companion roll can each be driven by an electric motor, which is a synchronous motor. By means of a controller the electric motors are controlled at a desired frequency for driving the delivery roll and the companion roll at the same circumferential speed. The layout of the drive units is based on the fact that for maintaining a yarn speed as constant as possible, the circumferential speed of the delivery roll and the circumferential speed of the companion roll must be kept constant. In practice, however, even slight inaccuracies in the casing of the delivery roll or in the casing of the companion roll lead to deviations in the casing diameters, which directly effect a change in the circumferential speeds. This effect results in that on the circumference of the companion roll, the yarn is either decelerated or advanced with overfeed. Interactions of this kind, however, lead to an unsteady advance of the yarn, which has a negative effect in particular when a plurality of yarns advance parallel in side-by-side relationship.

It is therefore an object of the invention to provide an apparatus of the initially described type wherein the yarn can be guided on the circumference of the delivery roll and on the circumference of the companion roll at a substantially constant speed.

SUMMARY OF THE INVENTION

The above and other objects and advantages of the invention are achieved by utilizing as the electric motor of the companion roll, an asynchronous motor which is controlled by a desired frequency and which has a motor slip. The invention has the special advantage that it permits operating the companion roll at a rotational speed, which adjusts itself to the actual circumferential speed of the delivery roll. The control of the asynchronous motor of the companion roll without any control feedback allows to accomplish that the load-dependent motor slip of the asynchronous motor causes on the circumference of the companion roll a circumferential speed to adjust, which is largely determined by the speed of the yarn and, with that, by the circumferential speed of the delivery roll.

In a particularly advantageous further development of the invention, the electric motor of the delivery roll is likewise an asynchronous motor, which has however a control feedback. To this end, the asynchronous motor of the delivery roll includes a sensor, which is used for measuring an actual frequency. Via a signaling line, the actual frequency is supplied to the controller, in which the desired frequency undergoes a correction. Since both the asynchronous motor of the delivery roll and the asynchronous motor of the companion roll are controlled by the desired frequency of the controller, the asynchronous motor of the companion roll will also receive the change of the desired frequency in an analogous manner. This has the special advantage that it is possible to operate the asynchronous motors under load with a tendency to the same field orientation, so that the companion roll assists the delivery roll in applying an overall tensile force.

To obtain as much as possible a great adaptation of the circumferential speeds, a preferred further development of the invention provides for making the asynchronous motor of the companion roll electrically as flexible as possible, i.e., the asynchronous motor of the companion roll has a relatively large motor slip. In comparison therewith, the asynchronous motor of the delivery roll is made with as little motor slip as possible.

The delivery roll and the companion roll may have essentially identical diameters. However, it is preferred to construct the companion roll with a substantially smaller outer surface diameter. To this end, the asynchronous motor of the companion roll is provided with a smaller number of pole pairs for converting the desired frequency into a corresponding circumferential speed. By maintaining a relation, in which the ratio of the delivery roll diameter to the companion roll diameter equals the ratio of the pole pairs in the asynchronous motor of the delivery roll to the pole pairs in the asynchronous motor of the companion roll, the delivery roll and companion roll may have any differences in diameter.

However, there also exists the possibility of purposefully adjusting yarn tension changes in the loopings of the yarn between the delivery roll and the companion roll. To this end, the delivery roll and/or companion roll have at least one diametrical step. This construction is especially advantageous for subjecting the yarn, for example, to an entanglement within a preferably last looping of the yarn between the delivery roll and the companion roll.

To achieve a continuous change of the yarn tension, the delivery roll and/or the companion roll may have at least one conical section in its outer surface.

For heating the yarn, it is preferred to construct the delivery roll with a heating means, so that the outer surface of the delivery roll has a temperature that is required for treating the yarn.

To make better use of the slip of the asynchronous motor associated to the companion roll, an adjustment has been found satisfactory, wherein the circumferential speed of the companion roll is in the no-load operation of the asynchronous motor by about 0.1% to 10% above the circumferential speed of the delivery roll. With that, it is possible to utilize with advantage a braking effect of the yarns on the companion roll.

BRIEF DESCRIPTION OF THE DRAWINGS

In the following, further advantages of the invention are described in greater detail by means of an embodiment of an apparatus according to the invention with reference to the attached drawings, in which.

DETAILED DESCRIPTION OF THE PREFERRED EMBODIMENTS

Figure 1:
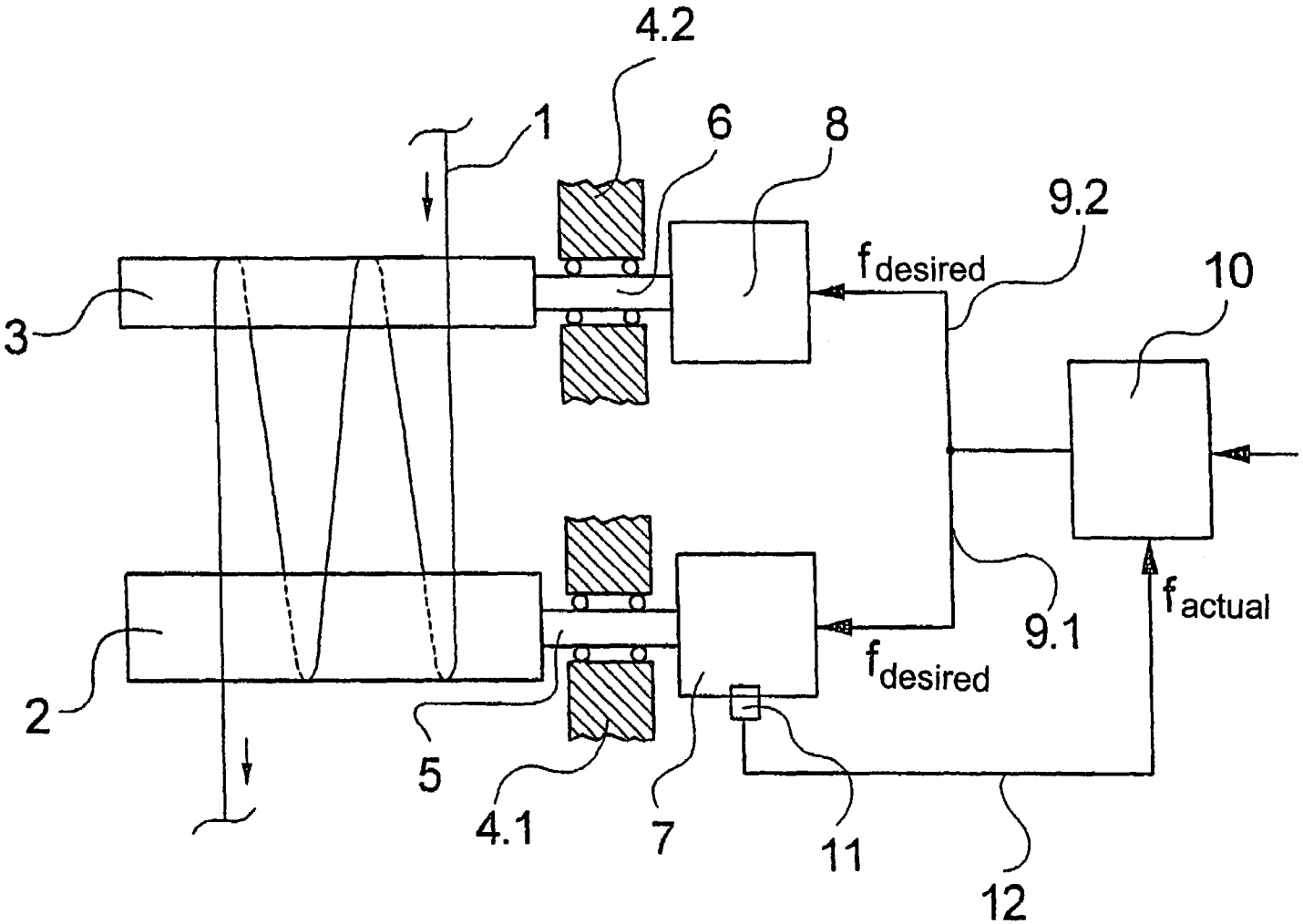
FIG. 1 is a schematic view of a first embodiment of the apparatus according to the invention.

FIG. 1 schematically illustrates a first embodiment of the apparatus according to the invention. The device comprises a delivery roll 2 and a companion roll 3 that is interconnected in spaced relationship with the delivery roll 2. The delivery roll 2 is rotatably supported in cantilever fashion in a support 4.1, and connected via a drive shaft 5 to an electric motor 7. The electric motor 7 of the delivery roll 2 is an asynchronous motor in the illustrated embodiment. The asynchronous motor 7 connects via a control line 9.1 to a controller 10. Also, the asynchronous motor 7 of the delivery roll 2 mounts a sensor 11 for measuring an actual frequency of the asynchronous motor 7. The sensor 11 connects via a signaling line 12 to the controller 10.

The companion roll 3 is supported in cantilever fashion in a support 4.2 and driven via a drive shaft 6 by an electric motor 8. The electric motor 8 of the companion roll 3 is an asynchronous motor, which connects via a control line 9.2 to the controller 10.

FIG. 1 illustrates the device of the invention in an operating situation. In this situation, a yarn 1 advances with a plurality of loopings over the delivery roll 2 and the companion roll 3. The illustrated embodiment shows only one yarn. However, it is preferred to use the apparatus of the invention for guiding a plurality of parallel advancing yarns 1. For example, to withdraw the yarn from a spinneret, or to draw it in a draw zone, the delivery roll 2 and the companion roll 3 are driven at substantially the same circumferential speed. To this end, the asynchronous motor 7 of the delivery roll 2 is controlled by the controller 10 at a predetermined desired frequency. To obtain a desired frequency on the delivery roll 2, the sensor 11 measures the actual frequency of the asynchronous motor 7 of the delivery roll 2 and supplies it via the signaling line 12 to the controller 10. With that, it is possible to achieve that the delivery roll 2 is driven at a predetermined desired frequency, which is independent of the motor slip of the asynchronous motor 7.

The asynchronous motor 8 drives the companion roll 3 at the identical desired frequency, which the controller 10 supplies via the control line 9.2 to the asynchronous motor 8. In comparison with the asynchronous motor 7, the asynchronous motor 8 has a smaller number of pole pairs, which is selected in accordance with the ratios of the outer surface diameter of the delivery roll 2 to the outer surface diameter of the companion roll 3. The asynchronous motor 8 of the companion roll 3 is made electrically very flexible, and thus has a relatively large motor slip. With that, the actual circumferential speed of the companion roll 3 adapts itself to the respective load situation because of the large motor slip of the asynchronous motor 8, so that no undesired interactions are produced on the yarn 1 between the delivery roll 2 and the companion roll 3. Thus, the uncontrolled circumferential speed of the companion roll 3 essentially adapts itself to the controlled circumferential speed of the delivery roll 2.

Figure 2:
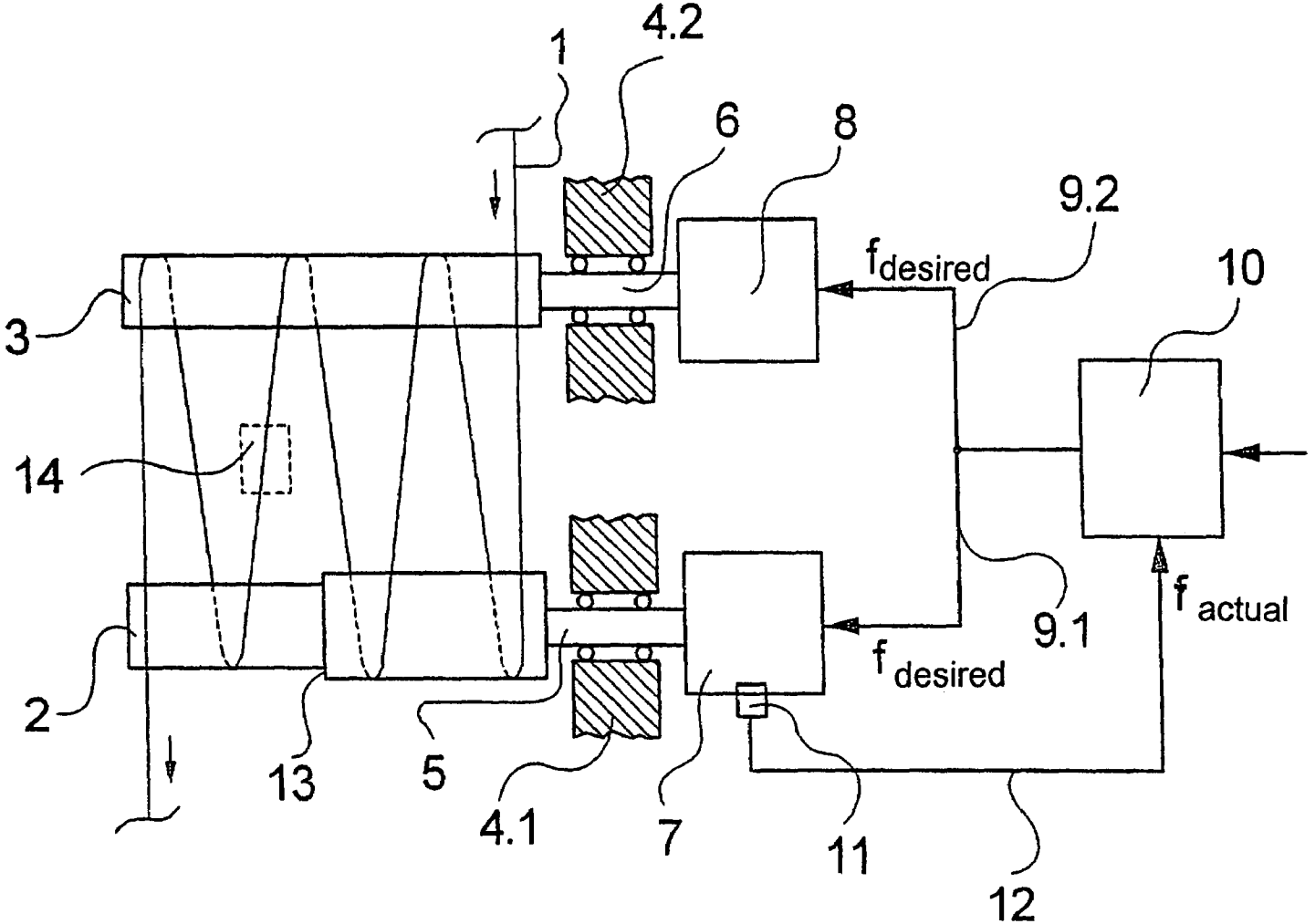
FIG. 2 is a schematic view of a further embodiment of the apparatus according to the invention.

FIG. 2 schematically illustrates a further embodiment of the apparatus according to the invention. The embodiment of FIG. 2 is substantially identical with the foregoing embodiment of FIG. 1, so that at this point the foregoing description is herewith incorporated by reference, and only differences are described in the following. In this connection, components of like function have been provided with the same numerals.

To drive the delivery roll 2 and the companion roll 3, electric motors 7 and 8 are used, which are asynchronous motors. The asynchronous motor 7 of the delivery roll 2 and the asynchronous motor 8 of the companion roll 3 are made identical, where the delivery roll 2 and the companion roll 3 have the same outer surface diameter. The adjustment of the asynchronous motor 7 for driving the delivery roll 2 and the control of the asynchronous motor 8 of the companion roll 3 are identical with the foregoing embodiment. Each of the asynchronous motors 7 and 8 is controlled by a desired frequency that is received from the controller 10, with the desired frequency being determined and supplied by the controller 10 in accordance with an actual frequency of the asynchronous motor 7 associated to the delivery roll 2.

In comparison with the foregoing embodiment, the delivery roll 2 of the embodiment in FIG. 2 is provided with a diametrical step 13 in its outer surface. The companion roll 3 has no diametrical step. This measure causes a differential speed to occur in the last loopings of the yarn 1 between the delivery roll 2 and the companion roll 3 in the transition zone of the diametrical step 13 on the outer surface of the delivery roll 2, which leads to a decrease of the tension in yarn 1. This decrease can be advantageously used for entangling the yarn 1 between the delivery roll 2 and the companion roll 3. To this end, FIG. 2 shows in phantom lines an entanglement nozzle 14.

Advantageously, the embodiments shown in FIGS. 1 and 2 may also be configured such that a synchronous motor drives the delivery roll 2. In this instance, the controller 10 controls the synchronous motor of the delivery roll 2 and the asynchronous motor of the companion roll 3 at an identical desired frequency. However, it is also possible to drive the delivery roll by an asynchronous-synchronous motor. In this case, the asynchronous component of the motor ensures, after being connected, an advantageous startup until the desired frequency is reached. Upon reaching the desired frequency, the synchronous component will then ensure that the delivery roll is driven at a frequency that does not deviate from the desired frequency. Thus, it is also possible to activate a plurality of delivery rolls via a common frequency changer.

Many other modifications of the invention set forth herein will come to mind to one skilled in the art to which these inventions pertain having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An apparatus for guiding and/or processing at least one advancing yarn comprising a delivery roll, and a companion roll positioned to cooperate with the delivery roll with the yarn repeatedly looping the delivery and companion rolls, a first electric motor connected to the delivery roll, a second electric motor connected to the companion roll, a sensor positioned to measure the actual frequency of the first motor, and a signaling line connecting the output of the sensor to a controller so that the first and second motors are controlled at a desired frequency via control lines leading from the controller to respective ones of the first and second motors, and wherein the second electric motor is an asynchronous motor which has motor slip sufficient to permit the companion roll to adapt itself to the controlled circumferential speed of the delivery roll.

2. The apparatus of claim 1, wherein the first electric motor of the delivery roll is an asynchronous motor.

3. The apparatus of claim 2, wherein the asynchronous motor of the companion roll has a substantially greater motor slip than the asynchronous motor of the delivery roll.

4. The apparatus of claim 2, wherein the delivery roll and the companion roll each have a diameter so as to permit defining a diameter ratio, and wherein the asynchronous motors each have a number of pole pairs so as to permit defining a pole pair ratio, and wherein the ratio of the diameter of delivery roll to the diameter of companion roll equals the ratio of the pole pairs in the asynchronous motor of the delivery roll to the pole pairs in the asynchronous motor of the companion roll.

5. The apparatus of claim 1, wherein the delivery roll and/or the companion roll include at least one diametrical step in its outer surface.

6. The apparatus of claim 1, wherein the delivery roll and/or the companion roll include at least one conical section in its outer surface.

7. The apparatus of claim 1, wherein the companion roll is configured such that its circumferential speed in the no-load operation of the asynchronous motor is above the circumferential speed of the delivery roll by about 0.1–10%.

8. The apparatus of claim 1, wherein the first electric motor comprises a synchronous motor.

9. The apparatus of claim 1, wherein the controller is free of any feedback from the second electric motor.

* * * * *